US007461913B2

(12) United States Patent
Kusakari

(10) Patent No.: US 7,461,913 B2
(45) Date of Patent: Dec. 9, 2008

(54) LIQUID DROPLET EJECTION APPARATUS

(75) Inventor: Tsutomu Kusakari, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 367 days.

(21) Appl. No.: 11/239,247

(22) Filed: Sep. 30, 2005

(65) Prior Publication Data

US 2006/0077219 A1 Apr. 13, 2006

(30) Foreign Application Priority Data

Sep. 30, 2004 (JP) ..... 2004-286023

(51) Int. Cl.
*B41J 29/393* (2006.01)

(52) U.S. Cl. ..... 347/19; 347/5; 347/67; 347/68

(58) Field of Classification Search ..... 347/19, 347/6, 14, 17, 81, 5, 67, 68
See application file for complete search history.

(56) References Cited

U.S. PATENT DOCUMENTS 5,757,392 A 5/1998 Zhang
6,398,329 B1 * 6/2002 Boyd et al. ..... 347/7
6,565,172 B2 * 5/2003 Huang et al. ..... 347/7

FOREIGN PATENT DOCUMENTS

JP 57-53366 A 3/1982
JP 3-272854 A 12/1991
JP 6-155733 A 6/1994

* cited by examiner

*Primary Examiner*—Matthew Luu
*Assistant Examiner*—Henok Legesse
(74) *Attorney, Agent, or Firm*—Birch, Stewart, Kolasch & Birch, LLP

(57) ABSTRACT

The liquid droplet ejection apparatus comprises: a liquid droplet ejection head which includes a plurality of pressure chambers communicating with a plurality of nozzles through which droplets of liquid is ejected toward a recording medium; a plurality of resistance elements which determine pressure inside the pressure chambers, the resistance elements presenting in a number of equal to or less than a number of nozzles; and a determination circuit in which a bridge circuit is configured with a group of four of the resistance elements and determines a state of droplet ejection of each of the nozzles.

8 Claims, 15 Drawing Sheets

LIQUID DROPLET EJECTION APPARATUS

BACKGROUND OF THE INVENTION

1. Field of the Invention

The present invention relates to a liquid droplet ejection apparatus, and particularly to a liquid droplet ejection apparatus in which each of liquid droplet ejection heads having a plurality of ejection ports is provided with a resistive sensor for determining conditions inside the liquid droplet ejection heads.

2. Description of the Related Art

There has been known as a liquid droplet ejection apparatus an inkjet recording apparatus (inkjet printer) with an inkjet head (liquid droplet ejection head) having multiple nozzles (liquid droplet ejection ports) arranged therein, in which the inkjet head and a recording medium are relatively moved and ink (liquid droplet) is ejected from the nozzles, whereby an image is formed on the recording medium.

As an ejecting method in such an inkjet recording apparatus, there have been known various methods. A known example is a piezoelectric printing system in which a diaphragm configuring a part of a pressure chamber (ink compressing chamber) is deformed due to deformation of a piezoelectric element (piezoelectric ceramic), the volume of the pressure chamber is changed, the ink is introduced into the pressure chamber from an ink supply channel when the volume of the pressure chamber is increased, and the ink inside the pressure chamber is ejected from nozzles as liquid droplets when the volume of the pressure chamber is reduced. There is also known a thermal inkjet printing system in which ink is heated by means of a heater to generate bubbles, and the ink is ejected by the expansion energy created as the bubbles grow.

In an image forming apparatus having in ink ejection head, such as an inkjet recording apparatus, although the ink is ejected by means of the various ejecting methods described above by feeding ink to the ink ejection head from an ink tank storing ink via an ink supply channel, it is necessary to stably discharge the ink so that the ejected amount, ejection speed, ejection direction, and the shape (volume) of the ink is always predetermined.

However, during printing, nozzles of an ink ejection head are always filled with ink so that printing can be executed immediately when there is in instruction for printing. Since the ink is exposed to the air, the ink inside the nozzles dries out, whereby the ink viscosity increases, causing clogs in the nozzles. Moreover, the ink viscosity changes due to environmental changes such as change in temperature, whereby the ink ejection condition becomes unstable.

In the related art, a resistive pressure determining element or temperature determining element is mounted on each of the nozzles in the ink ejection head to determine a state of the ink ejection head, whereby viscosity change of the ink is estimated based on ink ejection determination of temperature determination to change the drive waveform of the ink ejection head.

For example, as a system specializing in controlling the drive waveform by determining temperature, there is known a system in which a thermal resistance element (temperature sensor) is installed in the vicinity of each ink pressure chamber corresponding to each nozzle so that the ink temperature can be determined securely in response to even any temperature distribution or precipitous temperature change, and also the drive waveform with corrected amount of the ink viscosity change caused by the temperature change, whereby each of the piezoelectric elements is optimally driven automatically in response to the changes in the ink viscosity (see Japanese Patent Application Publication No. 3-272854, for example). By incorporating the temperature determination element in the drive circuit, a relatively simple circuit configuration is realized.

Moreover, for example, there is known a system in which nozzles are formed in a pressure sensor to form a nozzle plate for liquid injection apparatus, in other words, a nozzle plate is used as a pressure sensor constituted by a silicon diaphragm, to determine ink injection or pressure inside the pressure chamber (see Japanese Patent Application Publication No. 57-53366, for example). Further, in Japanese Patent Application Publication No. 57-53366, there is no particular description of a bridge circuit, but it has a drawing where the sensor is arranged in a form of a bridge circuit.

Furthermore, there is known, for example, a system in which pressure (change in ink) inside the chamber is determined every predetermined pulse by a pressure sensor disposed in the pressure chamber, or by a pressure sensor which also uses a drive element, and ejection of an ink droplet is subjected to feedback control so that printing is performed in a state in which change (pressure change) due to the ink property or environmental changes (see Japanese Patent Application Publication No. 6-155733, for example).

However, in the description in Japanese Patent Application Publication No. 3-272854, it is necessary to install a sensor and a determination circuit for each nozzle, and the problem here is that a circuit load is heavy.

Further, Japanese Patent Application Publication No. 57-53366 describes that a plurality of nozzles are arranged on one sensor plate to form a multi-nozzle plate, but the problem here is that the bridge circuit is not utilized proactively, and that the configuration of the determination circuit cannot be minimized.

Furthermore, in Japanese Patent Application Publication No. 6-155733, a determination circuit is necessary for every nozzle, and the problem here is that a circuit load is heavy.

SUMMARY OF THE INVENTION

The present invention has been contrived in view of the aforementioned circumstances, and an object thereof is to provide a liquid droplet ejection apparatus in which the number of determination circuits is minimized even when a liquid droplet ejection head has multiple liquid ejection ports, and the number of circuit parts is reduced.

In order to attain the aforementioned object, the present invention is directed to a liquid droplet ejection apparatus, comprising: a liquid droplet ejection head which includes a plurality of pressure chambers communicating with a plurality of nozzles through which droplets of liquid is ejected toward a recording medium; a plurality of resistance elements which determine pressure inside the pressure chambers, the resistance elements presenting in a number of equal to or less than a number of nozzles; and a determination circuit in which a bridge circuit is configured with a group of four of the resistance elements and determines a state of droplet ejection of each of the nozzles.

According the present invention, the number of the determination circuits can be minimized and the number of circuit parts can be reduced, which is advantageous for particularly a liquid droplet ejection head having multiple nozzles.

Preferably, the four resistance elements in the group configuring the bridge circuit correspond to four of the nozzles that are driven according to allocated times and do not eject the droplets simultaneously.

Preferably, the nozzles are in two-dimensional nozzle arrangement in which a plurality of rows of the nozzles, having the nozzles arranged therein in a direction forming a fixed angle that is not a right angle with a longitudinal direction of the liquid droplet ejection head, are arranged in the longitudinal direction of the liquid droplet ejection head; the four resistance elements in the group configuring the bridge circuit correspond to the nozzles selected from the rows of nozzles; and the selected nozzles are driven according to the allocated times by shifting by a predetermined amount of nozzle pitch in a sub-scanning direction of the rows of nozzles and a dot pitch in the sub-scanning direction of dots formed with the droplets of the liquid on the recording medium.

According the present invention, by taking the nozzles driven according to the allocated times as a bridge circuit, defects can be identified for every nozzle.

Preferably, the four resistance elements R1, R2, R3 and R4 in the group configuring the bridge circuit are connected to each other in this order in a clockwise direction; a terminal between the resistance elements R1 and R4 and a terminal between the resistance elements R2 and R3 are connected to a power supply; a terminal between the resistance elements R1 and R2 and a terminal between the resistance elements R3 and R4 are connected to a detector; and at least one of a pair of the resistance elements R1 and R2 and a pair of the resistance elements R3 and R4 corresponds to the nozzles that are driven simultaneously.

Preferably, the nozzles are in two-dimensional nozzle arrangement in which a plurality of rows of the nozzles, having the nozzles arranged therein in a direction forming a fixed angle that is not a right angle with a longitudinal direction of the liquid droplet ejection head, are arranged in the longitudinal direction of the liquid droplet ejection head; and pairs of the nozzles corresponding to the pair of resistance elements R1 and R2 and the pair of resistance elements R3 and R4 are lined up in a main scanning direction in the two-dimensional nozzle arrangement.

According the present invention, since the polarities of the determination waveforms are different, defects can be identified for every nozzle. In addition, determination can be performed even during a printing operation.

Preferably, a pair of the nozzles corresponding to a pair of the resistance elements that have a terminal connected to the detector therebetween is selected as the pair of the nozzles each of which is easily affected by the same level of disturbance and change.

Preferably, the pair of the nozzles each of which is easily affected by the same level of disturbance and change are communicated with a common supply flow passage which supplies the liquid to the nozzles.

According the present invention, even if a crosstalk is present on a pair of the resistance elements which have therebetween a contact terminal connected to the detector, it is possible to cancel the influence by the characteristics of the bridge circuit, whereby determination accuracy can be improved.

As described above, the liquid droplet ejection apparatus of the present invention can minimize the number of determination circuits and reduce the number of circuit parts. Therefore, the present invention is advantageous particularly for a liquid droplet ejection head having multiple nozzles.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
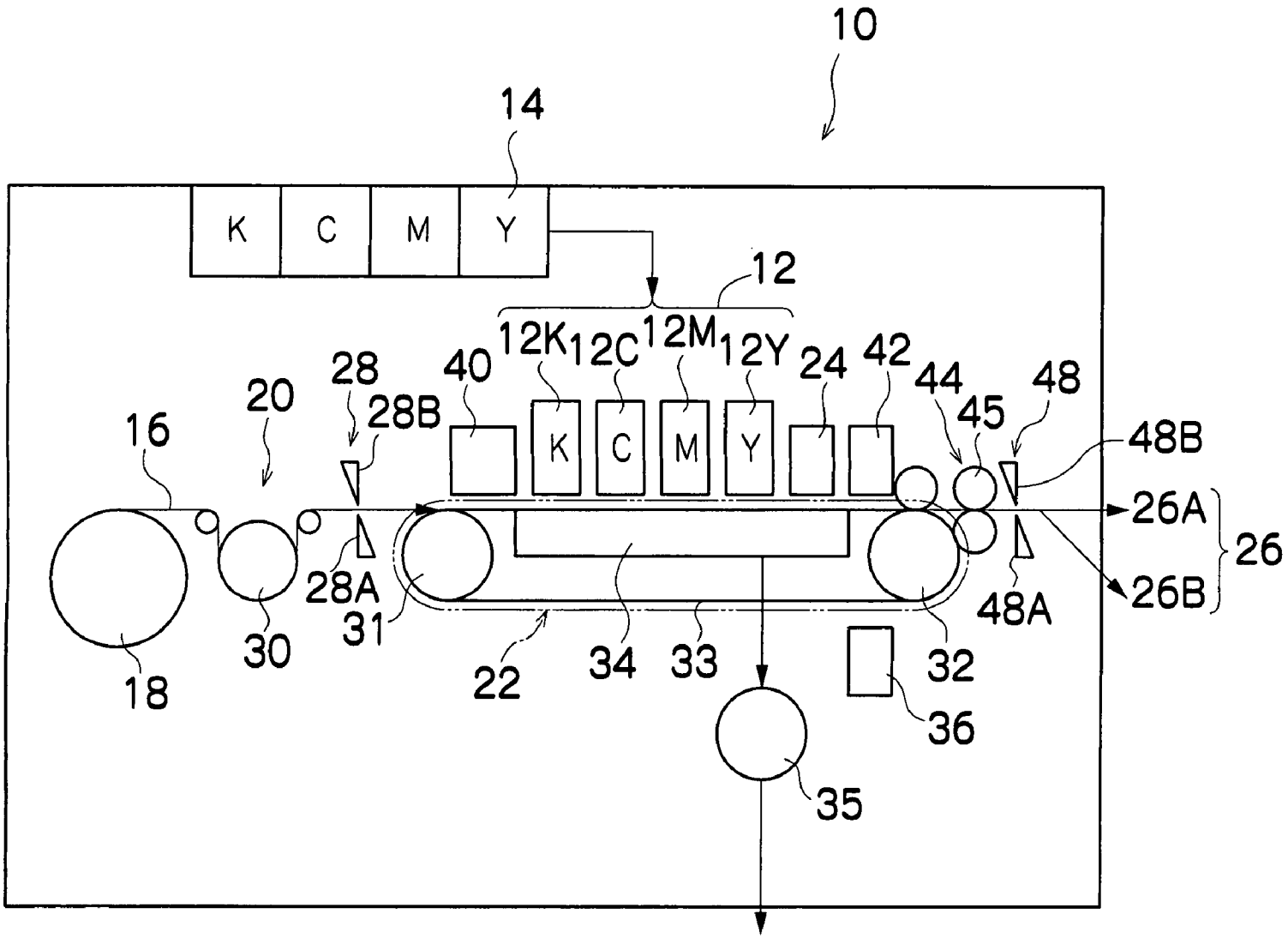
FIG. 1 is an entire configuration diagram showing schematically an embodiment of an inkjet recording apparatus as an image forming apparatus having a liquid droplet ejection apparatus of the present invention.

FIG. 1 is an entire configuration diagram showing schematically an embodiment of an inkjet recording apparatus as an image forming apparatus having a liquid droplet ejection apparatus of the present invention.

As shown in FIG. 1, the inkjet recording apparatus 10 comprises a printing unit 12 having a plurality of print heads (liquid ejection heads) 12K, 12C, 12M, and 12Y provided for respective colors of inks, an ink storing/loading unit 14 for storing inks to be supplied to the print heads 12K, 12C, 12M, and 12Y respectively, a paper supply unit 18 for supplying a recording paper 16, a decurling unit 20 for removing curl in the recording paper 16, a suction belt conveyance unit 22 disposed facing the nozzle face (ink discharge face) of the printing unit 12, for conveying the recording paper 16 while keeping the recording paper 16 flat, a printing determination unit 24 as a external non-ejection determination device for reading the printed result produced by the printing unit 12 outside the printing unit to determine insufficient ejection such as non-ejection of the ink, and paper output unit 26 for outputting printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration of an apparatus roll paper is used, a cutter 28 is provided as shown in FIG. 1, which cuts the roll paper into a desired size. The cutter 28 has a stationary blade 28A, whose length is equal to or greater than the width of the conveyor pathway of the recording paper 16, and a round blade 28B, which moves along the stationary blade 28A. The stationary blade 28A is provided on the reverse side of the printed surface of the recording paper, and the round blade 28B is disposed on the printed surface side across the conveyor pathway. It should be noted that when cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
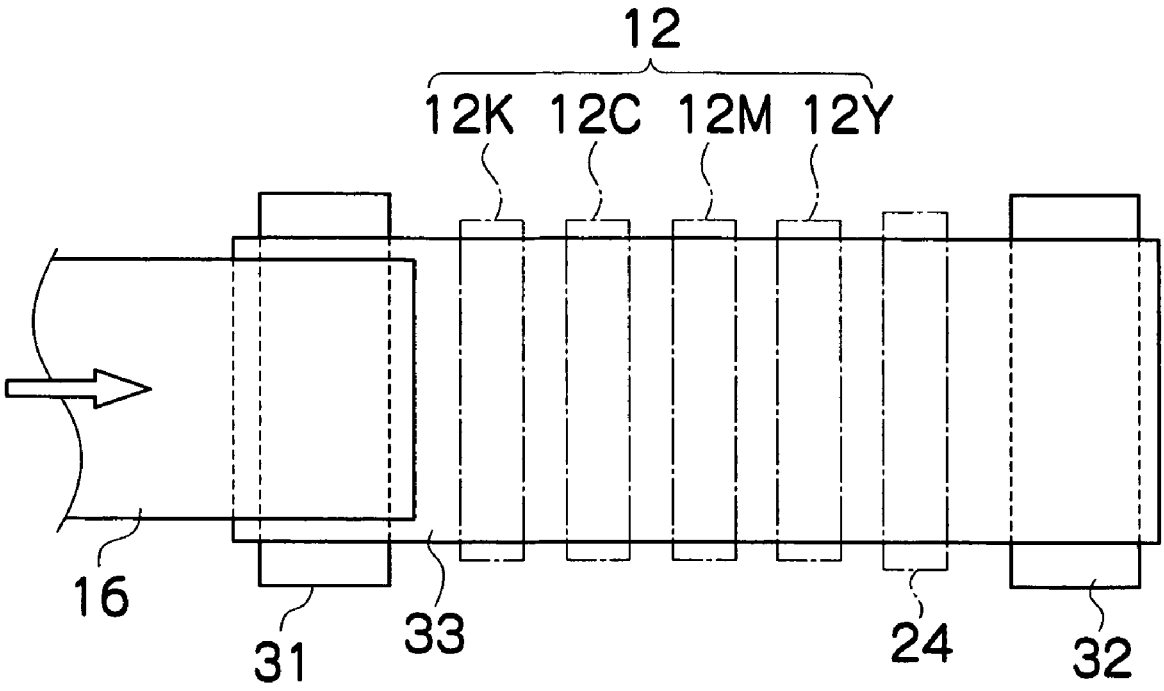
FIG. 2 is a plan view showing a substantial part around a printing unit of the inkjet recording apparatus shown in FIG. 1.

The printing unit 12 forms a so-called full-line head in which a line head having a length that corresponds to the maximum paper width is disposed in the direction perpendicular (main scanning direction) to the paper conveyance direction (sub-scanning direction) (see FIG. 2).

As shown in FIG. 2, each of the print heads 12K, 12C, 12M, and 12Y is composed of a line head, in which a plurality of ink-droplet ejection ports (nozzles) are arranged along a length that exceeds at least one side of the maximum-size recording paper 16 intended for use in the inkjet recording apparatus 10.

The print heads 12K, 12C, 12M, and 12Y are arranged in this order of the respective colors of black (K), cyan (C), magenta (M), and yellow (Y) from the upstream side (left side in FIG. 1) along the conveyance direction (paper conveyance direction) of the recording paper 16. A color image can be formed on the recording paper 16 by ejecting the inks from the print heads 12K, 12C, 12M, and 12Y, respectively, onto the recording paper 16 while conveying the recording paper 16.

In this manner, according to the printing unit 12 in which a full line head covering the entire width of the paper is provided for each ink, an image can be recorded on the entire width of the recording paper 16 by moving once (in other words, by performing main scanning) the recording paper 16 and the printing unit 12 relatively with respect to the paper conveyance direction (sub-scanning direction). Therefore, printing at high speed is possible compared to a shuttle head in which the print head moves back and forth in the direction perpendicular to the paper conveyance direction (main scanning direction), and also productivity can be improved.

It should be noted that the "main scanning direction" and the "sub-scanning direction" are used to indicate the following. Specifically, in a full-line head having rows of nozzles that have a length corresponding to the entire width of the recording paper, the "main scanning" is defined as to print one line (a line formed of a row of dots, or a line formed of a plurality of rows of dots) in the width direction of the paper (the direction perpendicular to the conveyance direction of the recording paper) by driving the nozzles by either: (1)

driving all of the nozzles simultaneously; (2) sequentially driving the nozzles from one side toward the other; and (3) dividing the nozzles into blocks and sequentially driving the blocks of the nozzles from one side toward the other. The direction indicating one line (longitudinal direction of a belt-like region) which is recorded by this main scanning is called "main scanning direction".

On the other hand, the "sub-scanning" is defined as to repeatedly perform printing of one line (a line formed of a row of dots, or a line formed of a plurality of rows of dots) formed by the above-described main scanning by moving the full-line head and the recording paper relatively to each other. The direction for performing the sub-scanning is called "sub-scanning direction". In summary, the conveyance direction of the recording paper is the sub-scanning direction, and the direction perpendicular to the sub-scanning direction is the main scanning direction.

Although the configuration with the KCMY standard colors (four colors) is described in the present embodiment, combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing/loading unit 14 has tanks for storing the inks with colors corresponding to the print heads 12K, 12C, 12M, and 12Y, and the tanks are communicated with the print heads 12K, 12C, 12M, and 12Y through an unshown channel, respectively. The ink storing/loading unit 14 has a warning device (a display device, an alarm sound generating device, and the like) for warning when the remaining amount of any ink is low, and has a mechanism for preventing loading errors among the colors.

The printing determination unit 24 has an image sensor for capturing an image of the ink-droplet deposition result of the printing unit 12, and functions as a device to check for ejection defects such as clogs of the nozzles due to an ink-droplet-deposited image which is read by the image sensor. It should be noted that non-ejection may be determined by means of a resistive sensor only as an internal non-ejection determination device, which will be described hereinafter, so that the printing determination unit 24 is omitted.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The printing determination unit 24 reads a test pattern printed with the print heads 12K, 12C, 12M, and 12Y for the respective colors to determine ejection in each of the heads. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in the figure, a sorter for collecting images according to print orders is provided in the paper output unit 26A for the images.

Next, the arrangement of the nozzles (liquid ejection ports) of the print heads (liquid ejection heads) is described. The recording heads 12K, 12C, 12M and 12Y provided for the respective inks have the same structure, so a reference numeral 50 is designated hereinafter to any of the recording heads 12K, 12C, 12M and 12Y, and FIG. 3 is a plan perspective view of a print head 50.

Figure 3:
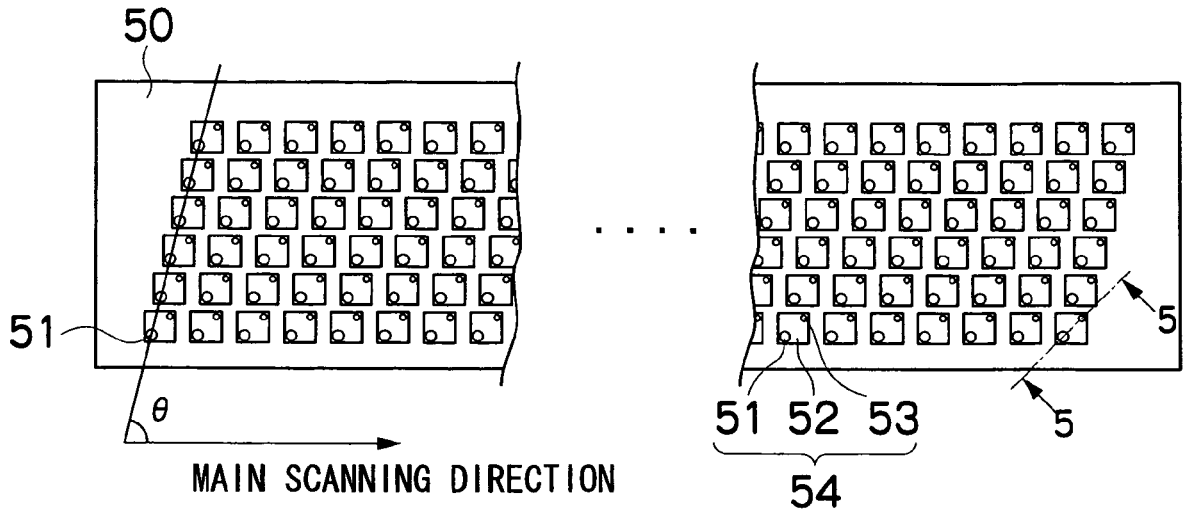
FIG. 3 is a plan perspective view showing a constructional example of a print head.

As shown in FIG. 3, in the print head 50 in the present embodiment, there are disposed, in a two-dimensional staggered matrix, pressure chamber units 54, each of which comprises a nozzle 51 for ejecting ink-droplets, a pressure chamber 52 for applying pressure to the ink when the ink is ejected, and an ink supply port 53 for supplying the ink to the pressure chamber 52 through a common flow passage which is not shown in FIG. 3, whereby a high density of the nozzle 51 is achieved.

The size of the nozzle disposition on the print head 50 is not particularly limited, but, for example, a structure with 2400 nozzles per inch is achieved by arranging the nozzle 51 in 48 lines (21 mm) horizontally and 600 (305 mm) rows vertically.

In the example shown in FIG. 3, the planar shape of the pressure chamber 52 is substantially a square when viewed from the top, but the planar shape of the pressure chamber 52 is not limited to a square. As shown in FIG. 3, the nozzle 51 is formed on one end of a diagonal line of the pressure chamber 52, and the ink supply port 53 is provided on the other end.

As shown in FIG. 3, the nozzle 51 has a structure in which a plurality of rows of nozzles, which are arranged in the direction (an oblique direction) having a fixed angle θ that is not a right angle with the main scanning direction along the longitudinal direction of the print head 50 (the correct definition is described hereinafter), are arranged in a form of two-dimensional nozzle arrangement.

Figure 4:
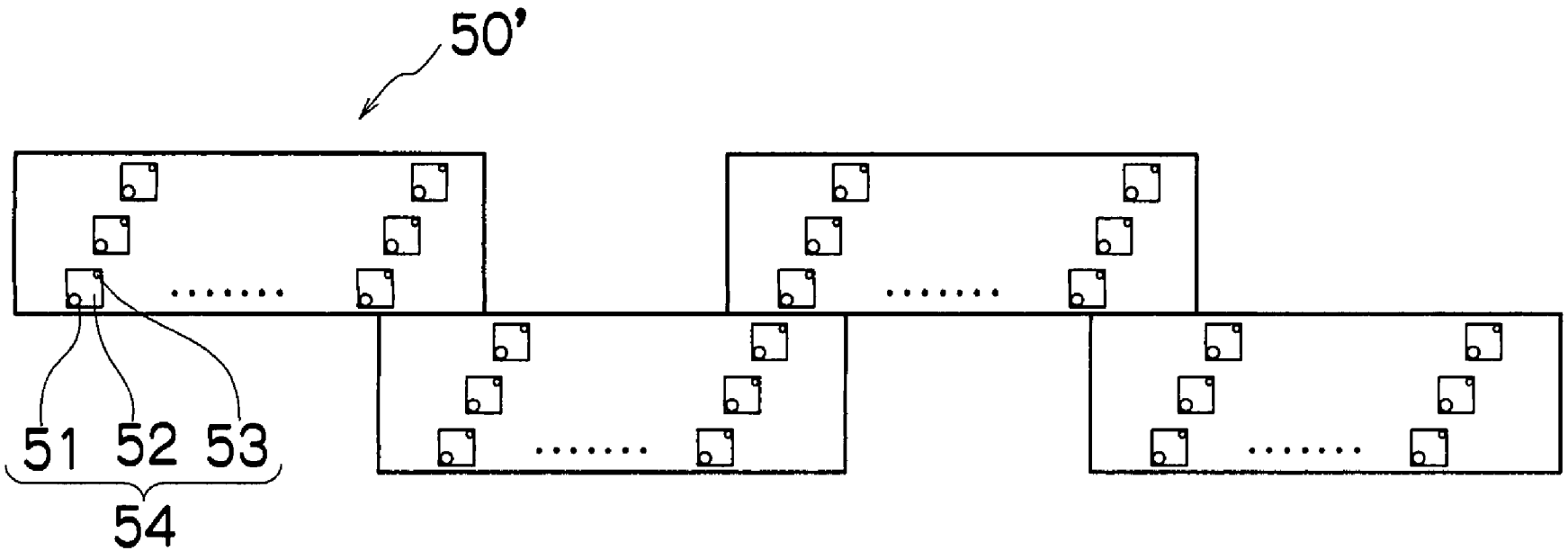
FIG. 4 is a plan view showing another example of the print head.

Further, FIG. 4 is a plan perspective view showing an example of configuration of the print head. As shown in FIG. 4, a long full-line head may be composed by combining a plurality of short heads 50' which are arranged in the form of a two-dimensional staggered matrix and combined so as to form nozzle rows having lengths that correspond to the entire width of the printing medium.

Figure 5:
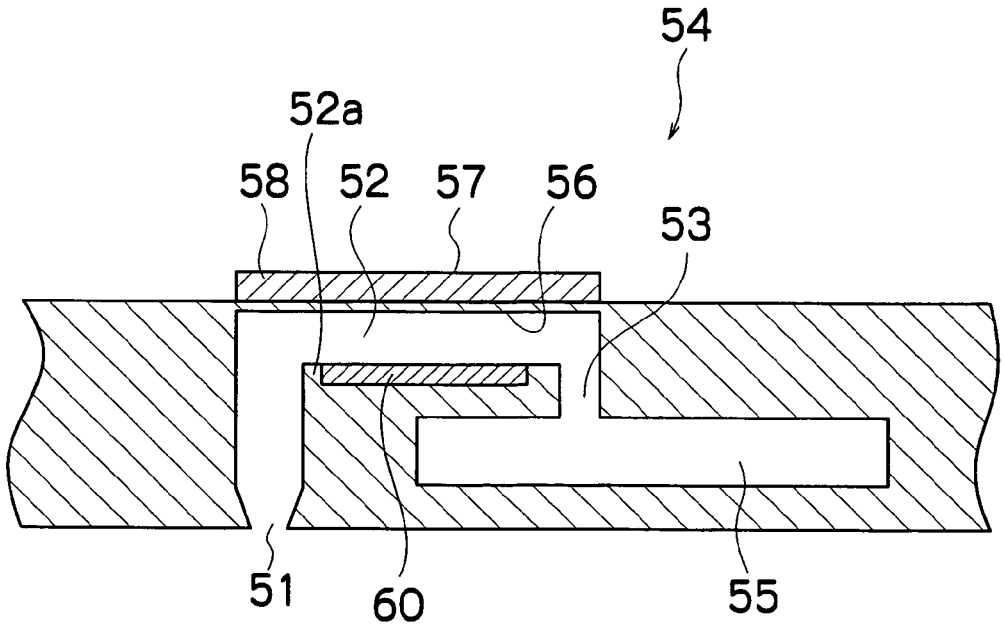
FIG. 5 is a cross sectional view taken along a line 5-5 in FIG. 3.

FIG. 5 is a cross sectional view taken along a line 5-5 in FIG. 3.

As shown in FIG. 5, the pressure chamber unit 54 is formed with the pressure chamber 52 communicated with the nozzle 51 for ejecting ink, and the pressure chamber 52 is communicated with a common flow passage 55 for supplying the ink via the supply port 53, and one surface (top surface in the figure) of the pressure chamber 52 is constituted by a diaphragm 56. A piezoelectric element 58 for applying pressure to the diaphragm 56 to deform the diaphragm 56 is bonded to the upper portion of diaphragm, and an individual electrode 57 is formed on the upper surface of the piezoelectric element 58. The diaphragm 56 also functions as a common electrode.

The piezoelectric element 58 is disposed between the common electrode (diaphragm 56) and the individual electrode 57, and deforms itself by applying drive voltage to these two electrodes 56, 57. The diaphragm 56 is pressured by the deformation of the piezoelectric element 58, and the volume of the pressure chamber 52 is reduced, whereby the ink is ejected from the nozzle 51. The piezoelectric element 58 returns to the original form after application of voltage between the two electrodes 56, 57 is canceled, and the volume of the pressure chamber 52 recovers to the original size, whereby new ink is supplied to the pressure chamber 52 from the common channel 55 through the supply port 53.

Moreover, on an inner wall 52*a* of the pressure chamber 52, a resistive sensor 60 (resistance component, resistance element) for determining a state inside the pressure chamber 52, as the internal non-ejection determination device for determining an ejection defect such as non-ejection inside the printing unit 12. Examples of the resistive sensor 60 include a pressure determination element, a piezo-resistance element, a distortion determination element in which is used a distortion resistance element such as Ni—Cr or Cu—Ni, these elements being used for determining the ink pressure inside the pressure chamber 52, or a temperature determination thermistor for determining ink temperature.

In the example shown in FIG. 5, the ejection drive source is the piezoelectric element 58, which determines ejection defects or ejection size by determining pressure by means of the resistive sensor 60. Further, when a temperature determination device such as the pressure determination thermistor is used as a resistive ejection sensor, the ejection size of the ink is acquired by determining temperature and ink viscosity, ejection characteristics such as spattering speed of ejected ink and ejection defects. In particular, in the case of a thermal inkjet head having a heater as the drive source, it is preferred that the temperature determination device be used as the resistive sensor.

Figure 6:
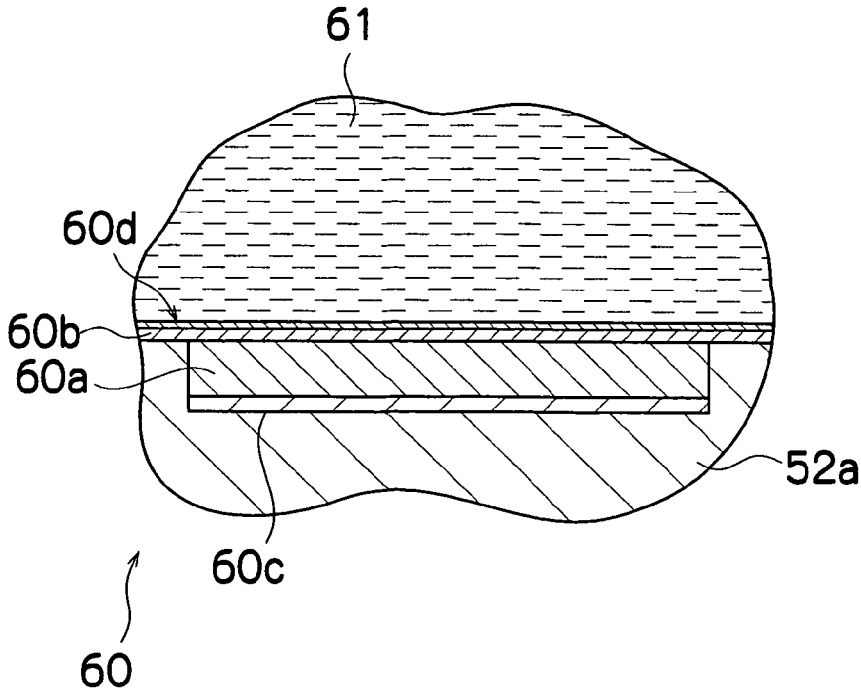
FIG. 6 is an enlarged cross sectional view showing a flat resistance element provided in a pressure chamber.

FIG. 6 shows an example of a flat piezo-resistance element as the resistive sensor 60. FIG. 6 is a cross sectional view of a flat sensor shown in a direction perpendicular to a sensor surface, and shows a state in which a flat piezo-resistance element 60*a* as the resistive sensor 60 is embedded in the partition wall 52*a* configuring the pressure 52, in order to determine ink pressure directly.

As shown in FIG. 6, the flat resistive sensor 60 is set such that a flat surface of the flat piezo-resistance element 60*a* is caused to be parallel to the partition wall 52*a* of the pressure chamber 52, and that the flat piezo-resistance element 60*a* is embedded in the partition wall 52*a* of the pressure chamber 52 so that pressure of ink 61 can be received on that flat surface. Electrodes 60*b*, 60*c* are respectively formed on a surface on the ink 61 side of the flat piezo-resistance element 60*a* and the side opposite from the surface on the ink 61 side. Further, the surface of the electrode 60*b* contacting the ink 61 is provided with a protective layer 60*d*.

The flat piezo-resistance element 60*a* is configured such that when it deforms upon reception of the pressure of the ink 61, a value of resistance between the electrodes 60*b*, 60*c* changes in response to the distortion.

At this moment, one flat resistive sensor 60 is set commonly in a plurality of pressure chambers 52, in which the electrode 60*b* for each of the plurality of pressure chambers 52 is taken as a common electrode, the electrode 60*c* is taken as an individual electrode operating for each of the pressure chambers 52, and reference voltage is applied, whereby change of the value of resistance for the respective pressure chambers 52 can be determined individually.

Further, when the flat piezo-resistance element 60*a* is set commonly in the plurality of pressure chambers 52, and the electrodes 60*b*, 60*c* set on both faces of the flat piezo-resistance element 60*a* are taken as the common electrodes, change of the value of resistance cannot be determined individually for the plurality of pressure chambers 52 in which the flat piezo-resistance element 60*a* is set. In this case, by driving (time-sharing drive) each of the pressure chambers 52 at time intervals, the pressure chambers 52 are distinguished, whereby generation voltage for each of the pressure chambers 52 can be determined individually.

Figure 7:
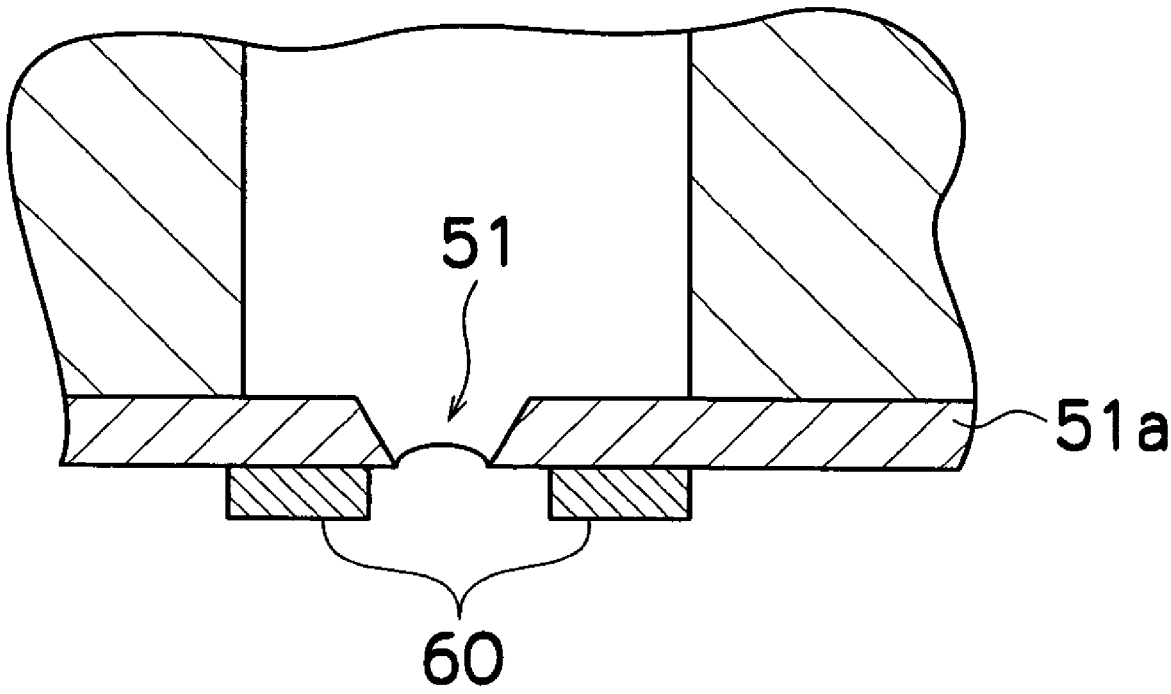
FIG. 7 is an enlarged cross sectional view showing a resistive sensor provided in a nozzle plate.

The set position of the resistive sensor 60 is not limited to the partition wall 52*a* of the pressure chamber 52 shown in FIG. 5, and may be any positions. For example, as shown in FIG. 7, the resistive sensor 60 may be set in the vicinity of the nozzle 51 of a nozzle plate 51*a* in which the nozzle 51 is formed.

Moreover, the flat piezo-resistance element 60*a* may be disposed in each of the pressure chambers 52 (each nozzle 51) one by one, but the flat piezo-resistance element 60*a* may be formed large, and one flat piezo-resistance element 60*a* may be disposed in the plurality of pressure chambers 52. At this moment, one of electrodes 62*b*, 62*c* as described above may be taken as a common electrode, and the other as a different electrode, or both electrodes may be taken as the common electrode.

When the other electrode is taken as a different electrode, the flat resistance element 60*a* of each of the pressure chambers 52 is separated electrically so that the pressure chambers 52 can be determined individually. On the other hand, when both electrodes are taken as the common electrode, the pressure chambers 52 cannot be determined individually, and when individual determination is attempted in such case, the pressure chambers 52 have to be subjected to time-sharing drive, for example.

Figure 8A:
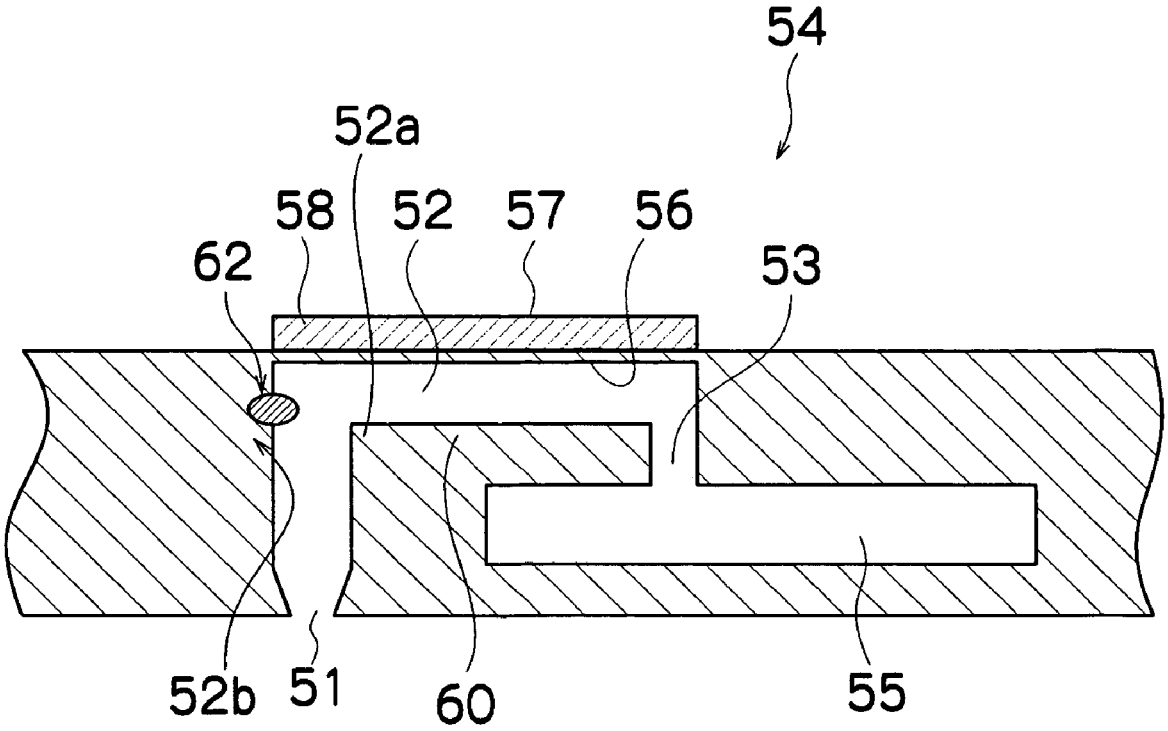
FIG. 8A is a cross sectional view showing a state in which a rod sensor is embedded in the pressure chamber, and FIG. 8 B is a cross sectional view showing an enlarged part of the rod sensor.
Figure 8B:
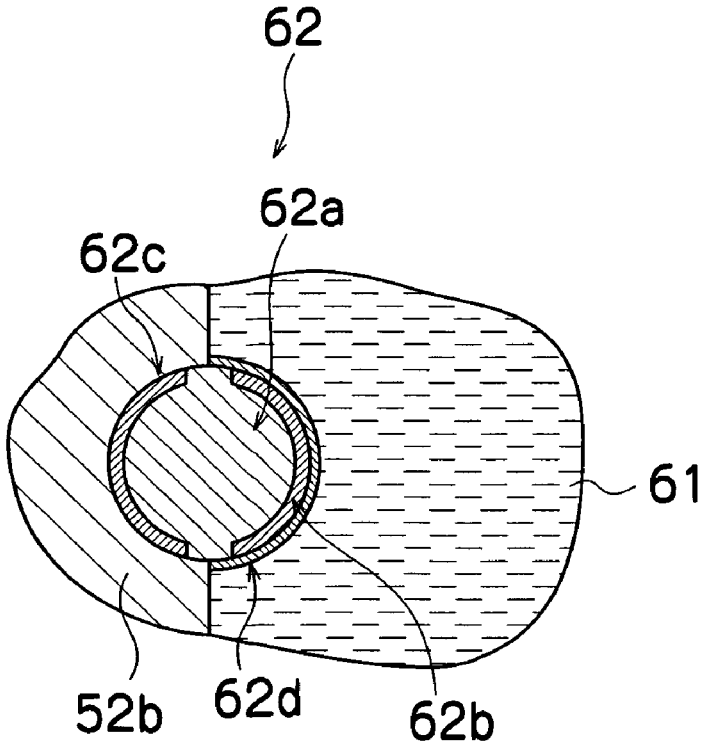

Furthermore, the shape of the resistive sensor 60 is not limited to a flat shape, thus it may be a thin and long rod sensor. FIG. 8A shows a state in which a rod sensor 62 is set in a partition wall 52*b* of the pressure chamber 52. FIG. 8B is a diagram showing an enlarged view of a part of the rod sensor 62, and is a cross sectional in a direction perpendicular to the longitudinal direction of the rod sensor 62.

As shown in FIG. 8B, the rod sensor 62 is set such that the longitudinal direction of the piezo-resistance element 62*a* in the form of a cylinder is disposed so as to be parallel to the partition wall 52*b* of the pressure chamber 52, and the piezo-resistance element 62*a* is embedded in the partition wall 52*b* so that the substantially half of the side surface of the piezo-resistance element 62*a* can receive pressure from the ink 61. As the cylindrical piezo-resistance element 62*a*, a composite piezo element obtained by forming a piezo element into a form of fiber and solidifying it with a resin is suitably exemplified.

On the side faces of the cylindrical piezo-resistance element 62*a*, electrodes 62*b*, 62*c* formed farther apart from each other on the side facing the ink 61 and on the side opposite therefrom where the piezo-resistance element 62*a* is embedded in the partition wall 52*b* of the pressure chamber 52. Moreover, the surface of the electrode 62*b* contacting the ink 61 is provided with a protective layer 62*d*.

As in the case of the flat resistive sensor 60 described above, one of the two electrodes 62*b*, 62*c* is taken as the common electrode and the other as an individual electrode, whereby pressure can be determined for each of the pressure chambers 52. For example, the electrode 62*b* on the side facing the ink 61 may be the common electrode, and the electrode 62*c* on the other side where the piezo-resistance element 62*a* is embedded in the partition wall 52*b* may be the individual electrode.

In the case of setting a resistive sensor as one pressure sensor set in the plurality of pressure chambers 52, such rod sensor may be set so as to penetrate into each of the plurality of pressure chambers 52, thus it is preferred that a rod sensor be used.

It should be noted that although the piezoelectric element is used to determine the pressure, it is not necessarily limited to the piezoelectric element, thus any pressure sensors can be utilized. Moreover, the shape of the sensor may be partially changed appropriately from the flat shape or rod shape as described above, as long as it is handled easily and does not damage the assembly characteristics.

Figure 9:
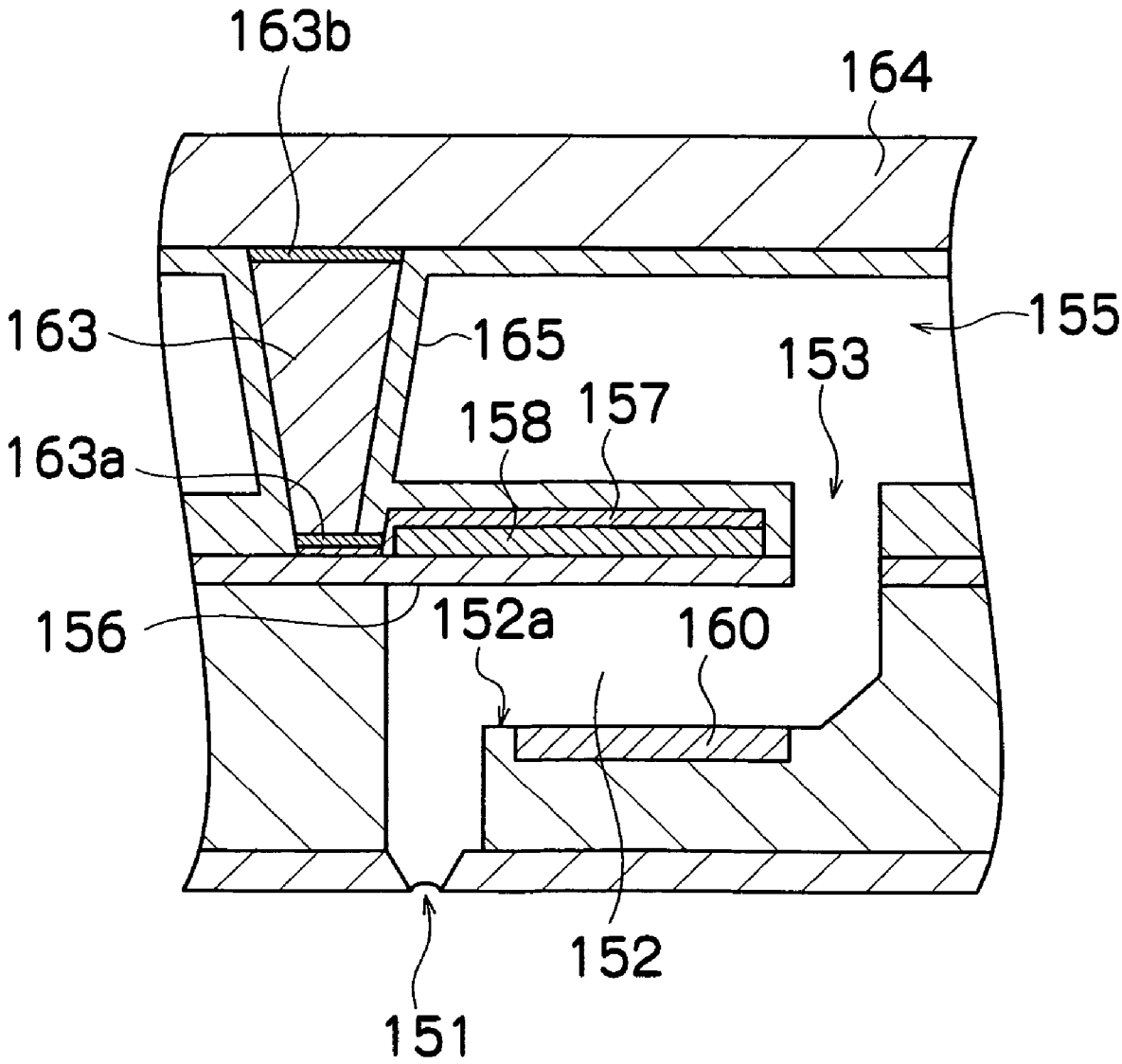
FIG. 9 is a cross sectional view showing another example of an ink supply channel.

Further, in the example shown in FIG. 5 or FIGS. 8A and 8B, the common flow passage 55 for supplying the ink to the pressure chamber 52 is formed on the nozzle 51 side from the pressure chamber 52, but the structure of the ink supply system is not limited to such structure. For example, as shown in FIG. 9, a common flow passage 155 may be disposed on an opposite side from a nozzle 151 with respect to a pressure chamber 152. At this moment, a diaphragm 156 forming the top surface (upper surface) of the pressure chamber 152 is penetrated substantially vertically to form an ink supply port 153.

In addition, the diaphragm 156 also functions as a common electrode, on which a piezoelectric element 158 is bonded, and an individual electrode 157 is formed on an upper surface of the piezoelectric element 158. Electric wiring 163 for supplying drive voltage for driving the piezoelectric element 158 to the individual electrode 157 is formed such that it stands up substantially at right angles with respect to a face including the piezoelectric element 158 from an electrode pad 163*a* drawn from the individual electrode 157. A multi-layer flexible cable 164 is disposed on the electric wiring 163*a* and is connected to the electric wiring 163 via an electrode pad 163*b*.

The common flow passage 155 is formed in the space which is formed between the diaphragm 156 and the multi-layer flexible cable 164 by the electric wiring 163 standing up in the form of a column substantially at right angles with respect the surface including the piezoelectric element 158. It should be noted that the common flow passage 155 is filled with the ink, thus the parts such as the electric wiring 163, individual electrode 157 and piezoelectric element 158 that contact with the ink are coated with an insulating/protective layer 165.

A resistive sensor 160 for determining a state inside the pressure chamber 152 is disposed on a partition wall 152*a* of the pressure chamber 152.

In the present embodiment, a non-ejection determination circuit is configured by obtaining the bridge circuit as an internal ejection determination device by combining the resistive sensors 60 disposed respectively in the plurality of nozzles 51 (pressure chambers 52).

Figure 10:
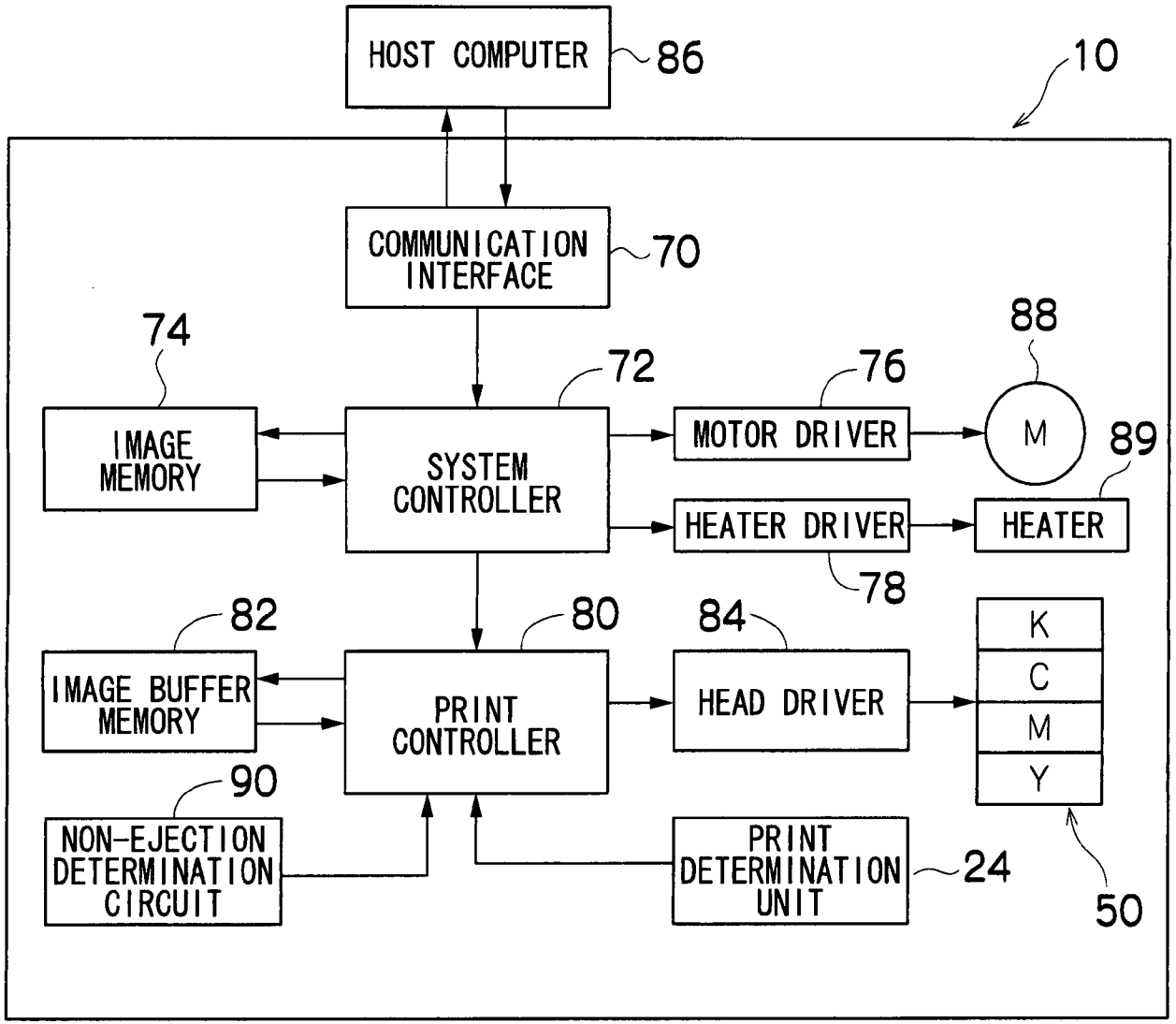
FIG. 10 is a block diagram of a substantial part showing a system configuration of the inkjet recording apparatus of the present embodiment.

FIG. 10 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface can be used as the communication interface 70. A buffer memory (not shown) for increasing the communication speed may be mounted in this unit. The image data sent from the host computer 86 is received by the inkjet recording apparatus 10 through the communication interface 70, and is temporarily stored in an image memory 74. The image memory 74 is a storage device for temporarily storing images inputted through the communication interface 70, and data is written and read to and from the image memory 74 through a system controller 72. The image memory 74 is not limited to memory composed of a semiconductor element, and a hard disk drive or another magnetic medium may be used.

The system controller 72 is a control unit for controlling various portions such as the communication interface 70, the image memory 74, a motor driver 76, and a heat driver 78. The system controller 72 is constituted by a central processing unit (CPU), peripheral circuits relating to same, and the like. The system controller 72 controls communications with the host computer 86 and read and write operations to and from the image memory 74, as well as generating control signals for controlling a motor 88 and a heater 89 of the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

A print control unit 80 is a control unit having an image processing unit 90 for performing image processing such as error diffusion, and a signal processing function for performing various treatment processes, corrections, and the like, in accordance with the control implemented by the system controller 72, in order to generate a signal for controlling printing, from the image data in the image memory 74, and also supplying the print control signal (print data) thus generated to a head driver 84.

Predetermined signal processing is carried out in the print control unit 80, and the ejection amount and the ejection timing of the ink droplets from the respective print heads 50 are controlled via the head driver 84, on the basis of the image data. The print control unit 80 is provided with image buffer memory 82, wherein data such as image data and parameters are temporarily stored in the image buffer memory 82 when image data is processed in the print control unit 80.

Further, determination signals from a printing determination unit 24 as the external non-ejection detection device and a non-ejection determination circuit 90 as the internal non-ejection determination device are input to the print control unit 80. The print determination unit 24 is, as described above, a block having a line sensor (not shown), reads an image printed on the recording paper 16, performs predetermined signal processing to determine a print status (the presence of the ejection, dispersion of the droplets, and the like), and presents the determination result to the print control unit 80.

The non-ejection determination circuit 90 is constituted by a bridge circuit formed by combining the plurality of resistive sensors 60 disposed respectively in the plurality of nozzles 51 (pressure chambers 52).

FIGS. 11A through 11D show an example of a pattern of a nozzle group having the resistive sensors 60 formed in one group of the bridge circuit.

In FIGS. 11A through 11D, white circles indicate the nozzles 51, and arrows S indicate the conveyance direction (sub-scanning direction) of the recording paper 16.

As shown in FIGS. 11A through 11D, as a nozzle group having the resistive sensors 60 (resistance elements) contained in a group of bridge circuit, various patterns of a group unit with a plurality of nozzles can be considered: a pattern in which four nozzles N1 through N4 are lined up in the sub-scanning direction as in pattern A shown in (a); a pattern in which four nozzles N1 through N4 are lined up in a matrix as in pattern B shown in (b); a pattern in which four nozzles N1 through N4 are lined in the main scanning direction as in pattern C shown in (c); and a pattern in which four of a group g composed of a plurality of nozzles N1 through N4 lined in the sub-scanning direction are lined in the main scanning direction as in pattern D shown in (d).

Figure 11A:
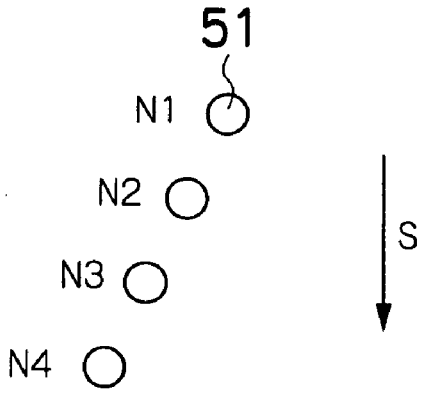
FIGS. 11A through 11D are explanatory diagrams showing the nozzle arrangement and patterns.
Figure 11B:
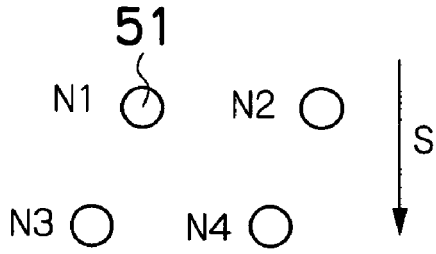
Figure 11C:
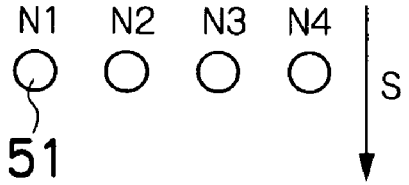
Figure 11D:
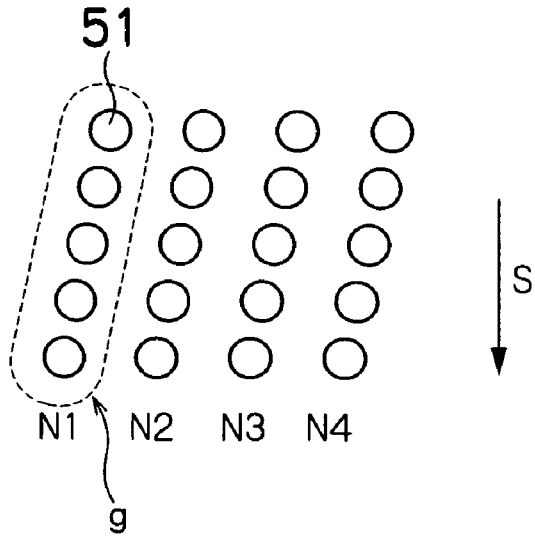

It should be noted that in the case of pattern D shown in FIG. 11D, N1 through N4 are not individual nozzles 51 but form a group of plurality of (five nozzles in FIG. 11D) nozzles 51.

Figure 12A:
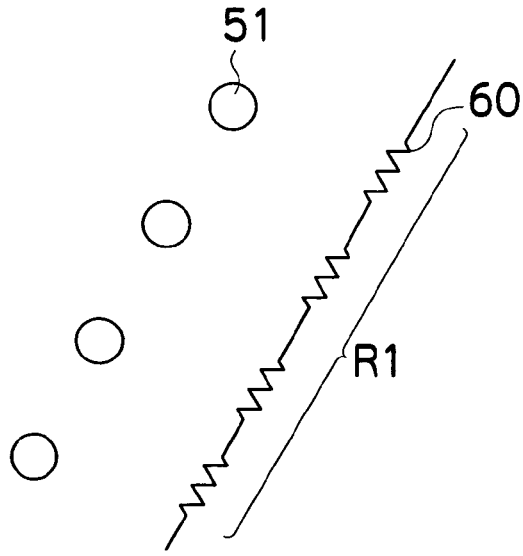
FIGS. 12A through 12C are explanatory diagrams showing responsiveness of the resistance element.
Figure 12B:
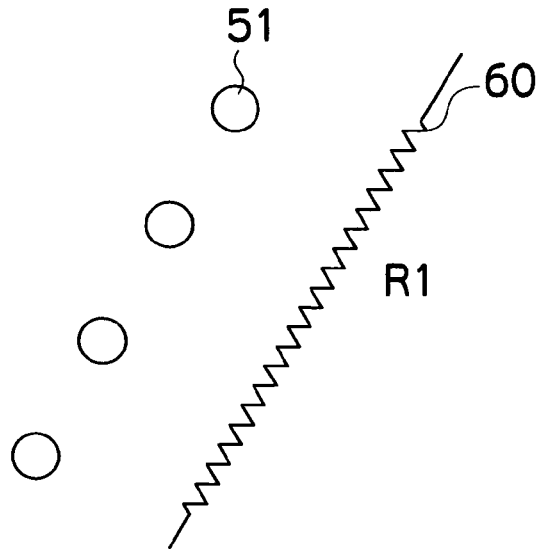
Figure 12C:
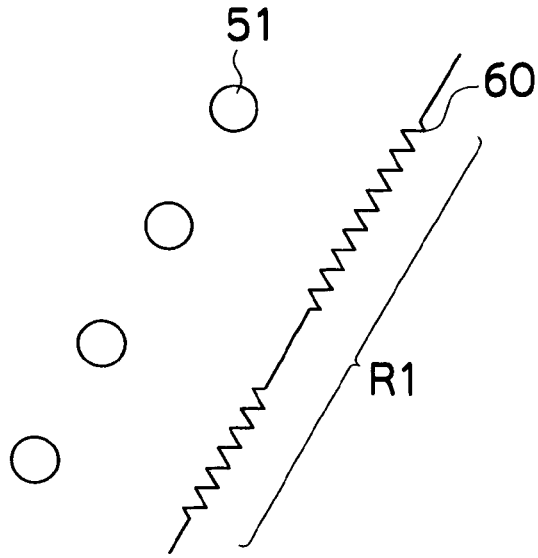

FIGS. 12A through 12C shows the relationship between each nozzle 51 and the resistive sensor 60 (resistance element) in the case of a group unit with a plurality of nozzles as in the abovementioned pattern D.

In the example shown in FIG. 12A, when one resistive sensor 60 is set in each nozzle 51, four resistive sensors 60 are assembled to form one resistance element R1 in the bridge circuit which is described hereinafter.

Moreover, in the example shown in FIG. 12B, one common resistive sensor 60 (e.g., the rod sensor described above) is set in each nozzle 51 to form one resistance element R1 in the bridge circuit.

In the example shown in FIG. 12C, one resistive sensor 60 corresponds to two nozzles 51, and these two resistive sensors 60 form one resistance element R1.

Figure 13:
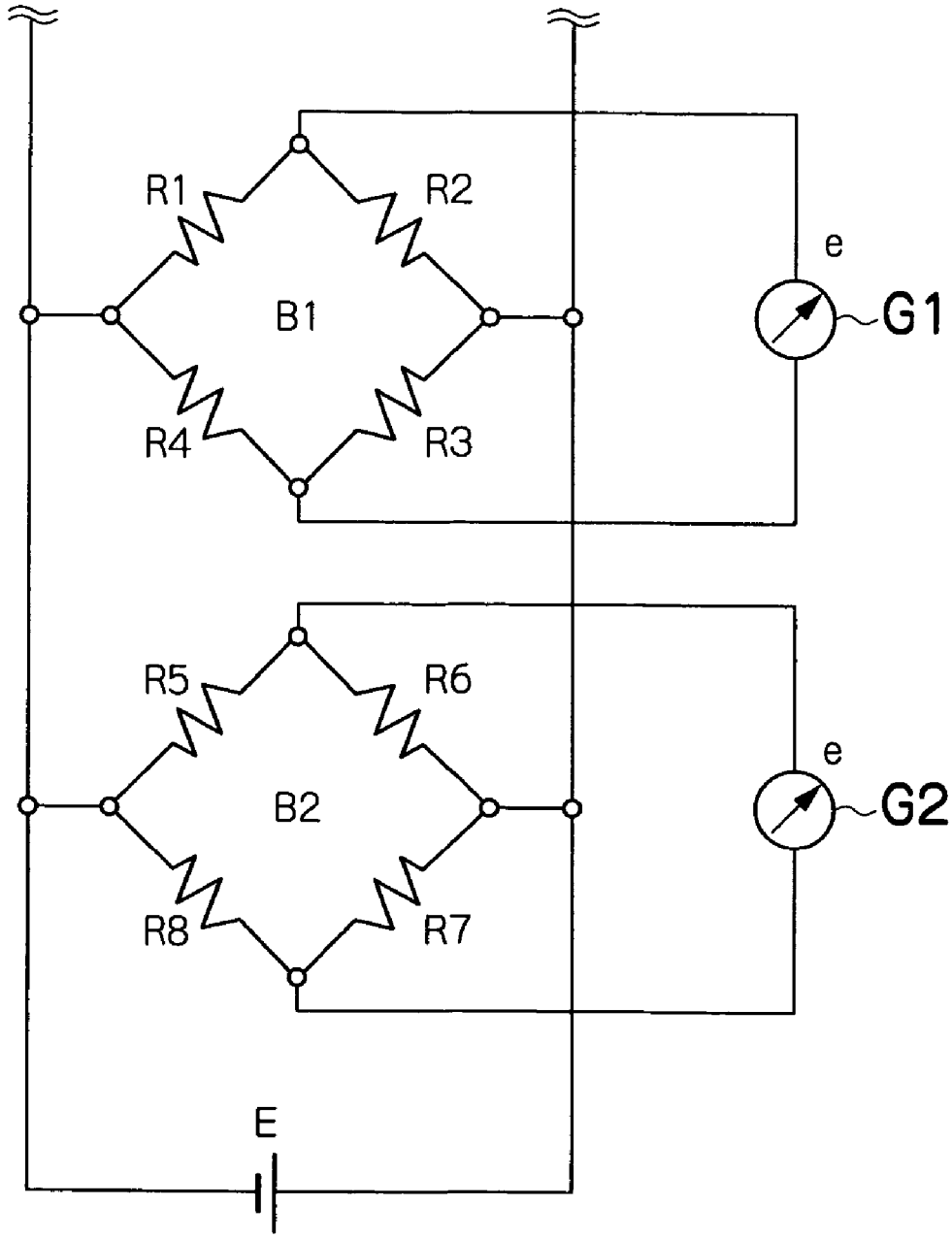
FIG. 13 is a circuit diagram showing an example of a bridge circuit.

FIG. 13 shows the bridge circuit configured by combining four resistance elements R1 through R4, R5 through R8 and the like corresponding to such nozzles or a group of nozzles.

As shown in FIG. 13, a bridge circuit B1 has four resistance elements R1, R2, R3 and R4 connected sequentially in the clockwise direction, in which a circuit drive power supply E is connected between the resistance elements R1 and R4 and the resistance elements R2 and R3. In response to input from the power supply E, a detector G1 is connected between the resistance elements R1 and R2, and the resistance elements R3 and R4.

Similarly, a bridge circuit B2 has four resistance elements R5, R6, R7 and R8 connected sequentially in the clockwise direction, in which a circuit drive power supply E is connected between the resistance elements R5 and R8 and the resistance elements R6 and R7. In response to input from the power supply E, a detector G2 is connected between the resistance elements R5 and R6, and the resistance elements R7 and R8.

In this manner, in the example shown in FIG. 13, a group of four resistance elements R1 through R4 is configured in the bridge circuit B11, and the detector G1 is connected to this to configure a determination circuit. Accordingly, this single detector G1 can determine a state (non-ejection or the like) regarding the four nozzles (or a group of nozzles) N1 through N4 to which the four resistance elements R1 through R4 correspond.

Therefore, a determination circuit is required for each nozzle in the prior art, but one determination circuit is enough for four nozzles (or resistance elements corresponding to the nozzles), thus, in the case of the example shown in FIG. 13, the determination circuit can be minimized to one fourth as compared with the determination circuit in the prior art.

It should be noted that the number of resistance elements configuring the bridge circuit is not limited to four (group of four), thus multiples of 4 such as 8 are possible, or the number of the resistance elements does not have to be multiples of 4 as long as the total values of resistance for each of the group of four resistance elements match.

Next, in the circuit configuration shown in FIG. 13, a method for selecting one nozzle or plurality of nozzles from a group of nozzles in each of the bridge circuits B1 and B2 to perform ejection determination is described.

First, a method for separating the nozzles N1 through N4 (or a group of nozzles) by delaying the ejection timing of the nozzles, to perform comparison with a threshold value is described.

At this time, for example, the nozzles N1 through N4 corresponding to the resistance elements R1 through R4 configuring the bridge circuit B1 are selected from the nozzle row forming a fixed angle θ that is not a right angle with the main scanning direction. Then, the nozzles are driven according to the allocated time by delaying the nozzle pitch in the sub-scanning direction of the nozzle row and the dot pitch on the recording paper by a predetermined amount.

Figure 14A:
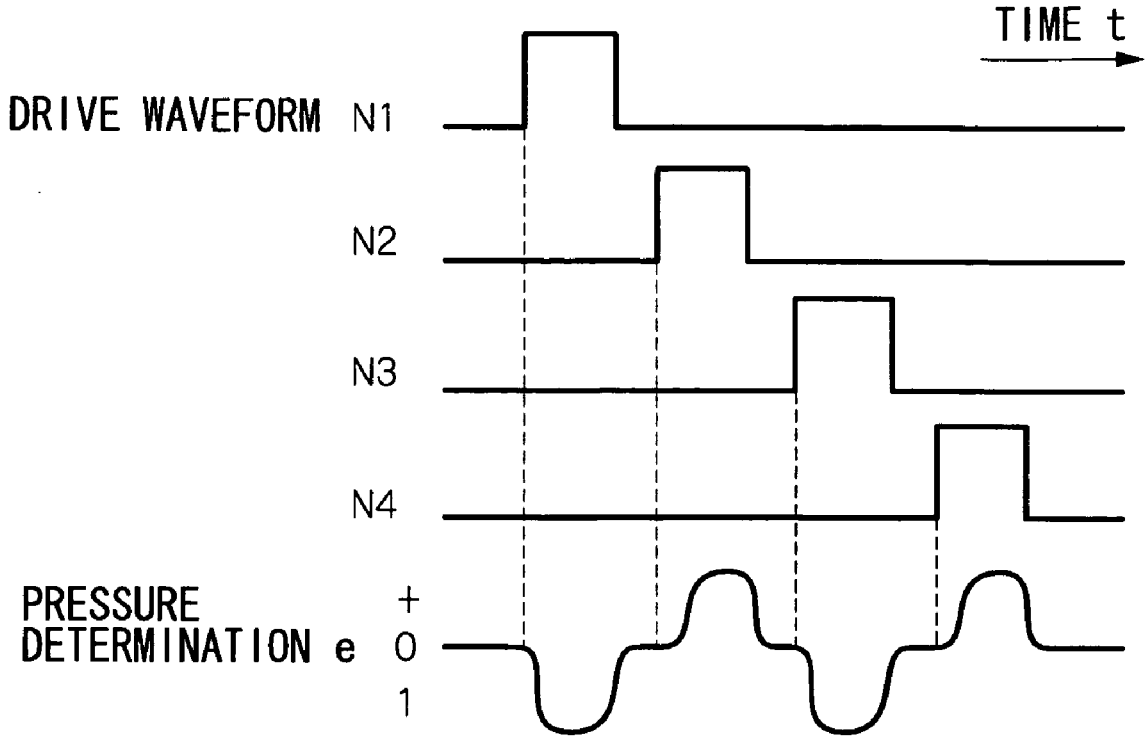
FIGS. 14A and 14B are line drawings showing waveforms at the time of determination, in which 14A shows a drive waveform and determination waveform when driving each nozzle according to the allocated time, 14B shows an example of a waveform when ejection is performed insufficiently.

FIG. 14A shows drive waveforms when driving the nozzles N1 through N4 with time delay and a determination waveform e in a detector G1 at this moment. The determination waveform e in the detector G1 corresponds to pressure determined by each of the resistive sensors 60.

As shown in FIG. 14A, when driving the nozzles N1 through N4 by separating them according to the allocated time, for example, suppose that the determination waveform e for the nozzle N1 is determined as pressure in the minus direction in the lower direction, and the determination waveform e for the nozzle N2 is determined as change in the upper direction. Suppose that the same is applied for the nozzles N3 and N4.

Figure 14B:
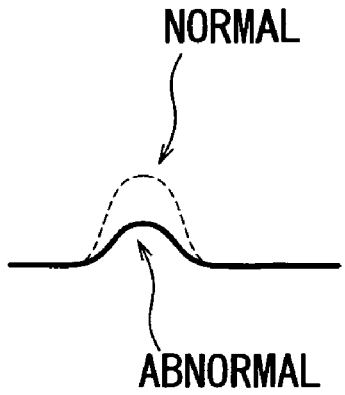

At this time, as shown in FIG. 14B, when only a weak waveform as shown in a solid line is obtained because of abnormal pressure or because pressure is not raised as compared to the waveform obtained at the time of normal ejection as shown with a broken lines, it is determined that the nozzles (or a group of nozzles) failed in ejection. In this manner, by separating the nozzles by delaying the ejection timing, it is possible to determine which nozzles (or a group of nozzles) fail.

Next, a case in which a plurality of nozzles (or a group of nozzles) are driven simultaneously to perform non-ejection determination is described.

At this moment in the bridge circuit B1, for example, suppose that the pair of nozzles N1 and N2, as well as the pair of nozzles N3 and N4 corresponding respectively to two resistance elements R1 and R2, as well as resistance elements R3 and R4, both of which have an output terminal to the detector G1 therebetween, are driven simultaneously. Alternatively, in the two-dimensional nozzle arrangement in which a plurality of rows of nozzles having a fixed angle θ that is not a right angle with the main scanning direction as shown in FIG. 3, two pairs of nozzles N1 and N2, and N3 and N4 which are driven simultaneously and correspond respectively to two resistance elements R1 and R2, as well as resistance elements R3 and R4, both of which have an output terminal to the detector G1 therebetween, are taken as nozzle pairs that are lined up (arranged so as to be adjacent to each other) in the main scanning direction.

Figure 15:
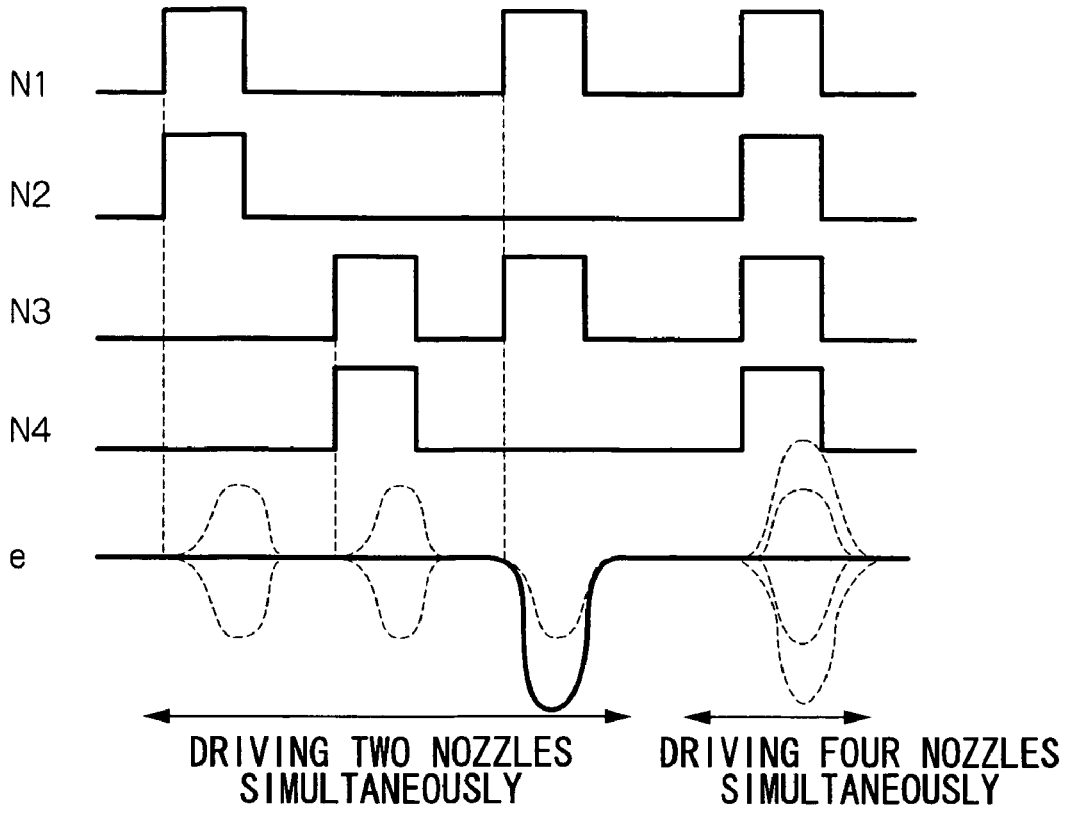
FIG. 15 is a line drawing showing a drive waveform and determination waveform when driving some of the nozzles simultaneously.

FIG. 15 shows an example of a drive waveform and a determination waveform in the case as described above. As shown in FIG. 15, first, the nozzle N1 and nozzle N2 are driven simultaneously, next the nozzle N3 and the nozzle N4 are driven simultaneously, then the nozzle N1 and the nozzle N3 are driven simultaneously, and finally all the nozzles N1 through N4 are driven simultaneously.

At this time, as shown in FIG. 14A, the determination waveform of the nozzle N1 and the determination waveform of the nozzle N2 are in the opposite directions, thus the changed portions of the resistance due to the pressure change are canceled each other, whereby no waveform is generated. The same is applied to the case in which the nozzle N3 and the nozzle N4 are driven simultaneously.

Furthermore, since the nozzle N1 and the nozzle N3 have waveforms in the negative direction, when these nozzles are driven simultaneously, waveforms doubled in size are formed in the minus direction. When all of the nozzles N1 through N4 are driven simultaneously, the changed portions of the resistance due to the pressure change are canceled each other out, whereby no waveform is generated.

At this moment, for example, when the nozzle N1 is normal, and the nozzle N2 is abnormal so the pressure does not change normally, the size of the determination waveform of the nozzle N2 is reduced as compared to its normal size, thus a determination waveform is generated on the minus direction side. Therefore, when a convex waveform is formed downward, the nozzle N1 can be judged as normal, and the nozzle N2 can be judged as failed in ejection. The same is applied to the case where the nozzle N3 and the nozzle N4 are driven simultaneously.

Next, when the nozzle N1 and the nozzle N3 are driven simultaneously, the both forms downward waveform, thus the both reinforce each other, whereby determination waveforms substantially doubled in size are obtained downward. Therefore, the nozzle N1 and the nozzle N3 can be judged as normal as long as a doubled threshold value is exceeded. Furthermore, if the threshold value is not exceeded, either one of the nozzle N1 or the nozzle N3 is judged as failed in ejection. However, the above-described information is not enough to judge which one of the nozzle N1 and nozzle N3 is abnormal in this case.

Furthermore, in the case in which all of the nozzles are driven simultaneously, if all nozzles are normal, all of them are canceled each other out, whereby basically no waveform is generated. Therefore, if a determination waveform is formed on the lower side, either one of the nozzle N2 or the nozzle N4 can be judged as failed, and if a determination waveform is formed in the upper side, either one of the nozzle N1 or the nozzle N3 can be judged as failed.

According to the above-described fact, non-ejection determination can be implemented even during a printing operation, according to each print status shown in FIG. 15.

It should be noted that when the nozzles judged as failed in ejection as described above are a group of nozzles g composed of a plurality of nozzles 51 as shown in FIG. 11D, this information is not enough to know which nozzle 51 in the group of nozzles g failed in ejection. Therefore, in order to specify a nozzle 51, which failed in ejection, from the group of nozzles g, the nozzles 51 in the group g are driven one by one according to the allocated time. By comparing each of thus obtained determination waveforms with a predetermined threshold value, a failed nozzle can be specified.

In this manner, for a group of nozzles judged as failed in ejection after roughly searching for an ejection failure for each group of nozzles, individual failed nozzle 51 is specified by driving each nozzle belonging to the group according to the allocated time, whereby an ejection-failed nozzle can be determined efficiently in a short amount of time as compared to the case in which all of the nozzles 51 are subjected to time-sharing drive from the beginning to search an ejection failure.

Moreover, when a plurality of nozzles 51 share, for example, an ink supply channel, it can be considered that each of the nozzles 51 is easily affected by the same level of disturbance such as pressure change and temperature change, thus it is preferred that these nozzles 51 form a pair to configure the bridge circuit. In addition, as a condition for selecting nozzles 51 to form a pair, the following cases can be considered: a case in which the nozzle plate, drive elements (considered as one drive source even if electrically separated) and the like have the same configuration member; a case in which the configuration members of the pressure chamber are the same; a case in which the configuration members and the like of the supply channel are the same; a case in which the distance from a head generation device is equal; a case in which the distance from the head periphery is equal; a case in which the types of the ejection liquid are the same; and a case in which the distance from the wiring member for drive or for a sensor is equal.

Figure 16:
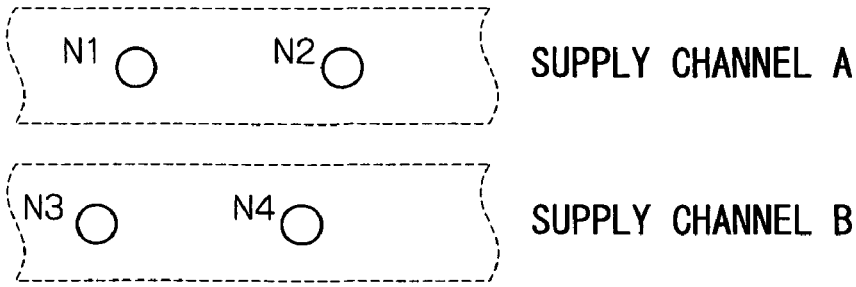
FIG. 16 is an explanatory diagrams showing an example where a pair of nozzles corresponding to a pair of resistance elements share the common supply channel.

FIG. 16 shows an example of a case in which a pair of nozzles share a feed channel. As shown in FIG. 16, the nozzle N1 and the nozzle N2 receive supply of the ink from the common supply channel A, and the nozzle N3 and the nozzle N4 receive supply of the ink from the common supply channel B.

Figure 17:
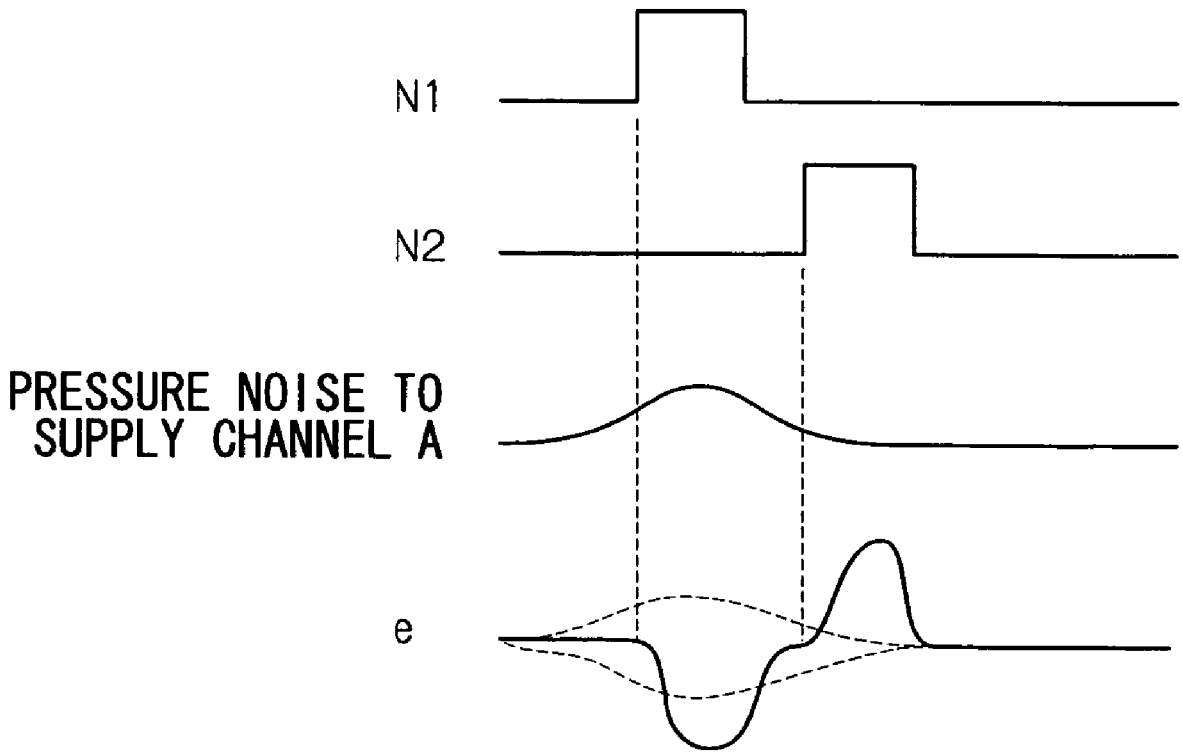
FIG. 17 is a line drawing showing the influence of noise on the determination waveform of the pair of resistance elements corresponding to the nozzles shown in FIG. 16.

At this time, a bridge circuit is configured by forming a pair of nozzles N1 and N2 and a corresponding pair of resistance elements R1 and R2. FIG. 17 shows drive waveforms and determination waveforms in such a case. The original determination waveforms with respect to the drive waveforms of the nozzle N1 and the nozzle N2 are the same waveforms shown in FIG. 14A. In this case, pressure noise of the supply channel A as shown in FIG. 17 is present.

Usually, as shown with a broken line in FIG. 17, the mountain of the waveform indicating the noise comes on top of each determination waveform of the nozzle N1 and nozzle N2. However, the nozzle N1 and the nozzle N2 form a pair to configure a bridge circuit, whereby an output is generated in a direction where both nozzles cancel each other out, thus the final output is basically generated when cancelling each other by the noise portion. As a result, detection accuracy can be improved.

In this manner, by forming a pair of nozzles or of groups of nozzles that share the common supply flow passage and structure to configure a bridge circuit, errors in pressure determination due to a cross talk between the adjacent pressure chambers, internal vibration, and temperature change are corrected, and correct determination can be performed.

It should be noted that mainly the pressure sensor is explained in the examples described above. However, the present invention can be preferably applied for determining temperature using a temperature sensor as the resistive sensor.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet ejection apparatus, comprising:

a liquid droplet ejection head which includes a plurality of pressure chambers communicating with a plurality of nozzles through which droplets of liquid are ejected toward a recording medium;

a plurality of resistance elements which determine pressure inside the pressure chambers, the resistance elements presenting in a number equal to or less than a number of nozzles, and each resistance element being associated with one or more nozzles that are different from one or more nozzles associated with others of the resistance elements; and a determination circuit in which a bridge circuit is configured with a group of four of the resistance elements and determines a state of droplet ejection of each of the nozzles.

2. The liquid droplet ejection apparatus as defined in claim 1, wherein the four resistance elements in the group configuring the bridge circuit are associated with four of the nozzles that are driven according to allocated times and do not eject the droplets simultaneously.

3. The liquid droplet ejection apparatus as defined in claim 1, wherein:

four resistance elements R1, R2, R3 and R4 in the group configuring the bridge circuit are connected to each other in this order in a clockwise direction; and wherein a terminal between the resistance elements R1 and R4 and a terminal between the resistance elements R2 and R3 are connected to a power supply;

a terminal between the resistance elements R1 and R2 and a terminal between the resistance elements R3 and R4 are connected to a detector; and at least one of a pair of the resistance elements R1 and R2 and a pair of the resistance elements R3 and R4 are associated with the nozzles that are driven simultaneously.

4. The liquid droplet ejection apparatus as defined in claim 1, wherein:

terminals between two different pairs of the resistance elements are connected to a detector; and the resistance elements in one of the different pairs of resistance elements are associated with a pair of the nozzles each of which is easily affected by the same level of disturbance and change.

5. The liquid droplet ejection apparatus as defined in claim 1, wherein:

the liquid droplet ejection head further includes a plurality of piezoelectric elements which receptively apply pressure to the liquid in the pressure chambers so as to eject the droplets of the liquid through the plurality of nozzles; and in order to determine the state of the droplet ejection of each of the nozzles, the determination circuit determines determination wave forms through the plurality of resistance elements when the plurality of piezoelectric elements are driven, each of the determination wave forms indication the pressure in one of the pressure chambers.

6. The liquid droplet ejection apparatus as defined in claim 2, wherein:

the nozzles are in two-dimensional nozzle arrangement in which a plurality of rows of the nozzles, having the nozzles arranged therein in a direction forming a fixed angle that is not a right angle with a longitudinal direction of the liquid droplet ejection head, are arranged in the longitudinal direction of the liquid droplet ejection head;

the four resistance elements in the group configuring the bridge circuit are associated with the nozzles selected from the rows of nozzles; and the selected nozzles are driven according to the allocated times by shifting by a predetermined amount of nozzle pitch in a sub-scanning direction of the rows of nozzles and a dot pitch in the sub-scanning direction of dots formed with the droplets of the liquid on the recording medium.

7. The liquid droplet ejection apparatus as defined in claim 3, wherein:

the nozzles are in two-dimensional nozzle arrangement in which a plurality of rows of the nozzles, having the nozzles arranged therein in a direction forming a fixed angle that is not a right angle with a longitudinal direction of the liquid droplet ejection head, are arranged in the longitudinal direction of the liquid droplet ejection head; and pairs of the nozzles associated with the pair of resistance elements R1 and R2 and the pair of resistance elements R3 and R4 are lined up in a main scanning direction in the two-dimensional nozzle arrangement.

8. The liquid droplet ejection apparatus as defined in claim 4, wherein the pair of the nozzles each of which is easily affected by the same level of disturbance and change are communicated with a common supply flow passage which supplies the liquid to the nozzles.

* * * * *